United States Patent [19]

Gulati et al.

[11] 4,287,018

[45] Sep. 1, 1981

[54] METHOD FOR FINISHING GLASS-PLASTIC LAMINATED LENS BLANKS

[75] Inventors: Suresh T. Gulati, Elmira; Anton A. Spycher, Big Flats, both of N.Y.

[73] Assignee: Corning Glass Works, Corning, N.Y.

[21] Appl. No.: 36,607

[22] Filed: May 7, 1979

[51] Int. Cl.[3] ..... C03C 15/00; C03C 19/00

[52] U.S. Cl. ..... 156/645; 65/31; 65/61; 65/111; 156/663

[58] Field of Search ..... 156/645, 663, 154; 65/31, 33, 61, 111

[56] References Cited

U.S. PATENT DOCUMENTS

| | | | |
|---|---|---|---|
| 3,580,789 | 7/1968 | Wenzel | 156/497 |
| 3,753,840 | 8/1973 | Plumat | 156/645 |
| 3,843,472 | 10/1974 | Toussrint et al. | 156/645 |
| 3,912,902 | 10/1975 | Herniter | 156/579 |
| 3,981,709 | 9/1976 | Kondo et al. | 65/61 |

OTHER PUBLICATIONS

Morey, G. *The Properties of Glass,* Reunhald Publishing Corp., New York N.Y. (1938) pp. 173–197.

Holland, L. *The Properties of Glass Surfaces,* John Niley & Sons Inc., New York, N.Y. (1964) pp. 17–21.

Stevens et al., Ed. *Introduction to Glass Science,* Plenum Press, New York, N.Y. (1972) pp. 457–465.

*Primary Examiner*—Jerome W. Massie

*Attorney, Agent, or Firm*—Kees van der Sterre; Clinton S. Janes, Jr.

[57] ABSTRACT

A method and apparatus for edge-grinding stressed laminated glass-plastic lens blanks wherein the lens blanks are heated during the abrasive edging process to reduce thermal stress breakage. The edged lenses are optionally etched to remove glass flaws, thus providing laminated lenses exhibiting improved resistance to thermal stress breakage in use.

6 Claims, 2 Drawing Figures

METHOD FOR FINISHING GLASS-PLASTIC LAMINATED LENS BLANKS

BACKGROUND OF THE INVENTION

The present invention is in the field of glass-plastic composites, and particularly relates to methods for edge-finishing glass-plastic laminated lenses which reduce the incidence of shaling fracture occuring during finishing.

It has been proposed to provide laminated articles comprising glass and plastic layers which would combine the desirable properties of both plastics and glasses, e.g., the light weight and toughness of plastics and the scratch resistance or light-responsive characteristics of glasses. For example, German Auslegeschrift No. 1,284,588 by Gliemeroth describes laminated glass-plastic articles comprising plastic and photochromic glass layers which could be used to provide optically clear glass-plastic laminates exhibiting photochromic properties.

A particularly desirable glass-plastic laminate for optical and ophthalmic applications is a laminate comprising a relatively thin sheet glass core element composed of photochromic glass which is positioned between two relatively thick plastic surface layers bonded to the front and back surfaces of the glass core. Such a laminate combines the desirable properties of very light weight and fatigue-free photochromic behavior. Laminates of this configuration may be produced by the high-temperature lamination of sheet glass and plastic members, or by casting plastic resins directly against the glass core to form the plastic surface layers of the laminate. The copending, commonly assigned application of S. T. Gulati et al., Ser. No. 018,107, filed Mar. 7, 1979, describes direct-cast laminated lenses.

One substantial problem which arises in the manufacture of a laminated glass-plastic lens blank of the kind described has been shaling fracture of the glass core member which occurs as the laminate is cooled to room temperature after processing at elevated temperatures, or as the laminate is subsequently handled. This type of failure occurs because the covering plastic surface layers, to which the glass core element is very strongly bonded, exhibit substantial shrinkage with respect to the glass core as the laminate is cooled from the processing temperatures used in laminate manufacture. This shrinkage gives rise to substantial tensile stresses in the plastic surface layers and compressive stresses in the glass core element in the planes parallel to the glass surface.

At the edges of the glass-plastic laminate, the tensile stresses in the surface layers are translated into bending moments which exert a large tensile stress in a direction normal to the glass core layer and across the exposed edge thereof. In the presence of this large tensile stress, referred to as a bond stress, mid-plane or shaling fracture of the glass core layer, which is under planar compression, can be initiated by any surface defects present at the edge of the glass core, resulting in separation of the glass core and the formation of two lens fragments, each comprising one of the plastic surface layers with a section of glass core bonded thereto.

As disclosed in the concurrently filed, commonly assigned copending application of A. A. Spycher, Ser. No. 36,796, the incidence of shaling fracture during the handling of a glass-plastic laminated lens blank can be significantly reduced through the use of a lens blank edge configuration wherein the bond stress exerted by the plastic surface layers is shifted to a point within the body of the glass core element which is spaced away from the edge thereof. However, while such blanks are more durable during lens blank shipment and through the initial stages of blank finishing which may comprise the grinding and polishing of the lens optical surfaces, they are still prone to breakage during edge finishing.

The production of a mounted lens assembly typically comprises an edge finishing step wherein material is removed from part or all of the edge of the lens to shape the lens to a selected configuration for mounting. In the case of glass-plastic laminated lens blanks of the kind herein described, it is found that, during removal of plastic and glass material from the edge of the lens during edge finishing, large flaws are introduced into the edge of the glass core element. In the presence of these flaws, the combination of vibration during edge finishing and the stresses exerted by the plastic surface layers of the laminate frequently results in the shaling failure of the lens blank before the edge finishing process can be completed.

It is a principal object of the present invention to provide an edge finishing method and apparatus which can be used to finish glass-plastic lens blanks comprising a thin compressively stressed glass core member without causing shaling fracture of the laminated lens blank.

It is a further object of the present invention to provide a finished glass-plastic laminated lens which exhibits enhanced resistance to shaling fracture in use.

Further objects and advantages of the invention will become apparent from the following description thereof.

SUMMARY OF THE INVENTION

The present invention includes a method for edge finishing a glass-plastic laminated lens blank comprising a relatively thin, compressively stressed glass core positioned between and adhesively bonded to two relatively thick, tensilely stressed plastic surface layers, wherein the lens blank is edge-finished at an elevated temperature so that the residual stresses giving rise to shaling fracture are at least partially relieved during the edging process. As a consequence of this stress relief, the lens can withstand the vibrational and other mechanical stresses of edge finishing without failure.

Broadly stated, the edge finishing method of the present invention comprises the steps of heating the laminated lens blank to an elevated temperature which is sufficient to at least partially relieve the stresses present in the core and surface layers of the lens, and subsequently grinding material from the edges of the lens, while maintaining the lens at said elevated temperature, to achieve a selected finished edge configuration in the lens. Thereafter the lens may be cooled to room temperature. The product of this edging process is a finished laminated glass-plastic lens exhibiting a pre-selected edge configuration which may be mounted in any manner desired in a frame or other assembly for use.

The invention further comprises improved lens edge grinding apparatus particularly suitable for edge-grinding laminated glass-plastic lens blanks according to the above-described finishing method, which apparatus further reduces the incidence of shaling fracture during finishing. Briefly, that apparatus comprises lens clamping spindles for rotatably mounting lens blanks to be edge-finished, which spindles incorporate lens contact clamping faces of improved design. These clamping faces reduce the amount of bending stress on the lens blank during edging.

An edge-finished glass-plastic laminated lens produced as above described, although useful for many applications, does retain edge flaws in the glass core which can cause shaling fracture of the lens if conditions of subsequent use are severe. In order to enhance the resistance of the lens to this type of failure, an optional additional step in the edge-finishing process may be employed, which comprises exposing the edge of the glass core of the edge-finished lens to a glass etching medium for a time at least sufficient to essentially completely remove edge flaws therefrom.

The edge-finished glass-plastic laminated lens resulting from this process incorporates a sheet glass core element having a circumferential outer edge which is essentially free from surface flaws, such flaws having been removed by the chemical etching of the glass. This core element can thus withstand significantly higher bond stress than can a core element which retains edge flaws introduced by initial cutting or by the edge finishing process.

BRIEF DESCRIPTION OF THE DRAWINGS

The invention may be further understood by reference to the drawings, wherein.

DETAILED DESCRIPTION

The present invention has primary application to the processing of a laminated lens blank comprising a relatively thin sheet glass core element or lamina and relatively thick plastic surface layers. For the purposes of the present description a laminated lens blank with a relatively thin glass core is one wherein the ratio of core thickness to total laminate thickness does not exceed about 1:4. Within this limitation, a suitable thickness range for the glass core is about 0.005–0.025 inches, and for the lens blank itself about 0.040–0.400 inches.

The bond stress present at the edges of a laminated lens blank such as described depends largely on the temperature at which the lens blank was processed into a bonded assembly. Although other factors also affect bond stress, including the configuration of the lens, the composition of the plastic materials used to form the lens surface layers, and the properties of any adhesive layers used between the core and surface layers, the biggest contribution to stress is the contraction of the plastic surface layers against the low-expansion glass core which occurs as the lens blank is cooled to room temperature after casting.

The incidence of lens blank failure by shaling fracture during finishing is found to be very high when the level of bond stress near the edges of the laminated lens exceeds about 4000 psi. Yet this bond stress does not have to be completely removed in order to obtain satisfactory selection rates from the edge finishing procedure. Thus it is not necessary, in heating the lens prior to edge finishing, to raise the temperature of the lens blank to its original bonding temperature; rather, the lens blank need only be heated to a temperature at which the bond stress near the edge of the blank is reduced to a level below about 4,000 psi. Useful temperatures for this purpose may range, for example, from 40°–100° C.

The method used to heat the lens blank during edge-finishing is not critical; any method which will uniformly raise the temperature of the blank may be employed. One preferred technique for controlling lens blank temperature during finishing is to continuously apply a heated flushing fluid to the lens blank during the edging operation. This fluid serves the dual purpose of flushing away glass and plastic material removed from the laminate edge by the edge-grinding process, and also maintaining the temperature of the lens at the temperature of the flushing fluid.

Figure 1:
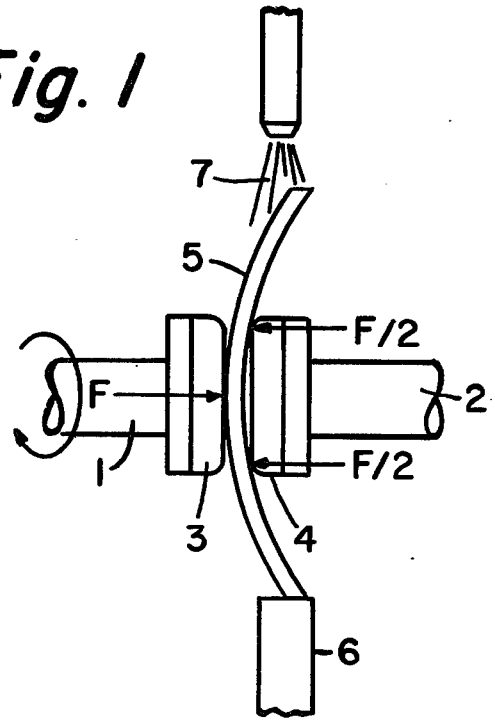
FIG. 1 is a schematic illustration of a pair of conventional lens clamping spindles supporting a lens blank for edging according to the prior art.

Apparatus utilized for edge-grinding conventional optical lenses typically includes a pair of coaxial rotating clamping spindles which retain and rotate the lens blank while the blank edge is abraded by contact with an abrading surface such as a rotating grinding wheel. FIG. 1 of the drawing schematically illustrates one assembly for performing this function, wherein a pair of opposed coaxially rotatable clamping spindles 1 and 2, having generally opposing clamping faces 3 and 4, press against and mutually retain a lens blank 5 clamped therebetween for edging. Edge material is removed from the lens blank by suitable grinding means such as grinding wheel 6, and a source of a liquid coolant 7 is provided to prevent localized overheating of the lens blank at the contact point between the lens edge and the grinding wheel, and to flush away removed lens material.

As suggested by FIG. 1, bending stresses are applied to lens blank 5 by the forces F and F/2 exerted by the lens contact faces of the clamping spindles, because these forces are not applied to mutually opposing surfaces of the blank. While normally not objectionable, such stresses should be avoided during the processing of laminated lens blanks.

In accordance with the present invention, edge grinding apparatus with an improved lens contact clamping face configuration, effective to reduce stress on the lens blank during edging, is provided. In that apparatus, the lens contact faces comprise mutually opposed resilient lens support surfaces adapted to contact the lens blank exclusively at mutually opposite surfaces thereof. By mutually opposed is meant that the support surfaces contact the lens blank at generally opposing points on either side of the surface formed by the curved blank.

Figure 2:
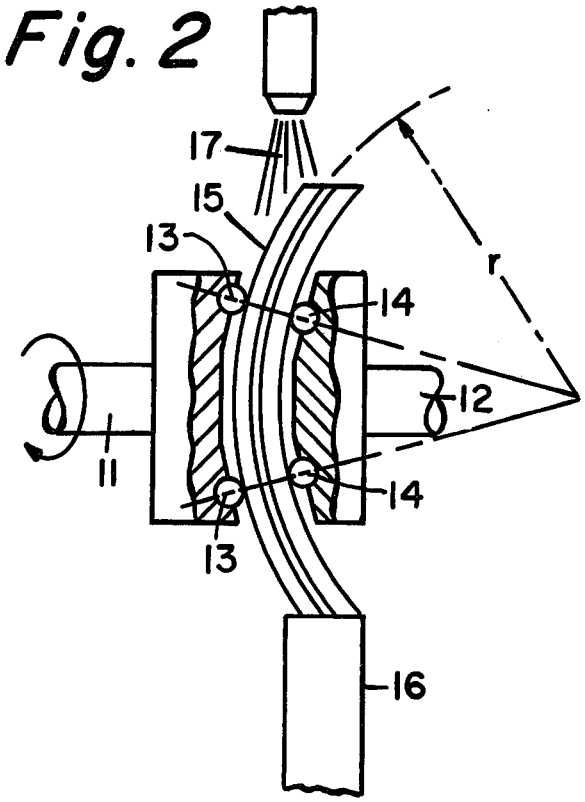
FIG. 2 is a schematic illustration of an improved clamping spindle configuration for supporting a laminated glass-plastic lens during edging according to the invention.

In a preferred embodiment, schematically shown by an elevational view in partial cross-section in FIG. 2 of the drawing, the lens contact faces on spindles 11 and 12 comprise mutually opposed resilient O-rings 13 and 14 which contact laminated lens blank 15 at opposite points on the lens blank surface. In the case of FIG. 2, the contact faces are exactly opposite in the sense that each pair of faces lies on a common radius of curvature for the spherical surface partly defined by the lens body. This is shown by the radius line Y in FIG. 2.

The lens blank is heated during the edging by a flow of heated flushing fluid 17 which is maintained at a temperature sufficient to reduce bond stress in the lens blank to a level below about 4000 psi. This heated fluid also performs the conventional functions of flushing away removed lens material and preventing localized overheating of the lens edge at the contact point between the edge and grinding wheel 16.

After the lens blank has been edge-finished as described, the completed lens may be cooled to room temperature and mounted in a suitable frame, if desired.

However the lens still has some susceptibility to shaling fracture if extensively handled or mechanically shocked, because the core edge retains flaws introduced during core manufacture or during the edging operation.

In order to further enhance the resistance of the lens to breakage, it is desirable to eliminate edge flaws from the glass core element by applying a glass etching medium such as a chemical glass etching solution thereto. Flaw elimination is accomplished by removing surface glass from the exposed edge of the glass core to a depth at least equivalent to that of the deepest flaws present thereon. In most cases, the removal of about 0.010" of glass from the core edge will insure essentially complete elimination of these edge flaws.

Chemical etching media useful for treating laminated lenses in accordance with the invention include any of the well-known etching solutions used for dissolving glass in the prior art. Such solutions may be broadly characterized as acidic solutions comprising fluoride ions, exemplified by aqueous solutions of fluoride compounds such as HF, $NH_4F$, $NH_4F.HF$ or the like, either alone or in combination with other acids or salts.

Many of the plastics which may be utilized to provide plastic surface layers or adhesive coatings for glass-plastic laminated lens blanks to be treated in accordance with the invention are unaffected by conventional glass etching solutions of the type useful for the elimination of core edge flaws. Therefore it is often possible to carry out the flaw elimination step by simply immersing the edge-finished laminated lens in a bath of a suitable etching solution for a time sufficient to achieve the flaw elimination required. In cases where it is desired to treat the edge-finished lens for edge flaw removal without risking lens fracture by cooling after edge finishing, heated etching solutions may be used and the lens immediately transferred to the heated etching solution after edge grinding.

EXAMPLE 1

To demonstrate by way of example the effectiveness of the method of the invention in preventing shaling fracture during edge finishing, a number of glass-plastic laminated lens blanks having thin glass core elements are manufactured. The glass core elements for these lens blanks are cut from 0.010-inch thick photochromic glass sheet, being about 2.5 inches in diameter and being coated on both sides with a layer of a bonding adhesive which is effective to bond the core to the plastic surface layers subsequently to be applied.

Allyl diglycol carbonate plastic surface layers approximately 2 mm. in thickness are provided on these glass core elements, being formed by casting commercially available CR-39® resin against the front and back surfaces of the adhesive-coated glass core elements and curing at a temperature of about 80° C. The bond stress near the edges of the laminated lens blanks thus provided approaches about 4000 psi.

Several of the laminated lens blanks prepared as described are edge-finished in accordance with a process wherein they are not heated prior to or during edge grinding, but are simply positioned between clamping spindles and edge-ground while being flushed with ordinary commercial coolant liquid at normal coolant temperatures (e.g., 20° C.). All such lens blanks fail by shaling fracture during the edge-grinding procedure.

The remainder of the lens blanks produced as described are edge-finished in accordance with a procedure wherein each lens blank is positioned between clamping spindles and preliminarily heated by flushing with hot flushing fluid. This fluid consisted of the commercial coolant liquid previously employed, which has first been heated to 70° C. for the purpose of uniformly raising and maintaining the temperature of lens blank at that level. Edge grinding of lens blanks is then accomplished while maintaining the flow of heated flushing liquid over the lens. Following edge grinding, the finished lenses are removed intact from the clamping spindles. No cases of shaling fracture during edge finishing are encountered.

Although hot blank edging as above described may be accomplished either with conventional clamping spindles, such as shown in FIG. 1 of the drawing, or with improved clamping spindles, such as shown in FIG. 2, it is preferred to use the improved clamping spindle configuration of FIG. 2 to further reduce the possibility of breakage during edging. Lenses produced in accordance with the described procedure are quite suitable for use in applications where conventional lenses are employed. However their properties may be further improved in accordance with the etching procedure hereafter described.

EXAMPLE 2

For the purpose of further enhancing the resistance of finished lenses produced in accordance with the hot blank edging procedure of Example 1 to shaling fracture in use, each lens is transferred, while still hot from the edging operation, into a chemical glass etching bath which is maintained at 60° C. This glass etching bath consists of about 28% concentrated HF, 12% concentrated $H_2SO_4$ and 60% $H_2O$, by volume.

The finished lenses are maintained in this etching bath for about 90 minutes, a time interval which is sufficient to remove approximately 0.010" of glass from the edges of the glass core elements thereof. This treatment insures essentially complete elimination of edge flaws from the core elements of the lenses. After this treatment, the lenses are removed from the bath, cooled, rinsed with distilled water, and tested for resistance to shaling fracture.

Testing for resistance to shaling fracture may be accomplished by cooling the lenses below ambient temperatures, since cooling rapidly increases the bond stresses applied to the edges of the glass core element due to differential thermal expansion between the glass and plastic elements. Sufficient cooling can cause failure by shaling fracture even in lenses comprising flaw-free glass core elements provided as above described. It is found that all of the lenses which are subjected to the core etching treatment above described withstand cooling to at least 15° C., without shaling breakage due to cooling stress.

EXAMPLE 3

To further illustrate the effectiveness of core etching treatments to enhance the resistance of laminated lenses to shaling fracture, a number of additional laminated lenses, are selected for testing. These lenses are produced, not by direct casting, but by the lamination of preformed 2 mm. thick plastic surface layers to 0.010-inch thick glass core elements with an adhesive at a lamination temperature of 30° C.

These lenses are segregated into two groups and the first group is core-etched by exposure to the glass etching solution of Example 2 at a temperature of 20° C. for a time interval of 2 hours. This treatment is effective to remove 0.010" of glass from the edges of the core elements of the laminates. It is found that 75% of the core-etched laminated lenses from this first group survive cooling to −30° C. without shaling fracture. On the other hand, the lenses of the second group, which are not subjected to a glass etching treatment, exhibit poor resistance to cold stress fracture. Hence, no lens from this group survives cooling to 0° C. without breakage.

Of course, the foregoing examples are merely illustrative of edging procedures and edged lenses which may be provided in accordance with the invention. It will be appreciated that variations and modifications of the above-described procedures and products may be resorted to by one skilled in the art within the scope of the appended claims.

We claim:

1. A method for edge-finishing a glass-plastic laminated lens blank comprising a relatively thin, compressively stressed sheet glass core element positioned between and adhesively bonded to two relatively thick, tensilely stressed plastic surface layer elements, which comprises the steps of:

(a) heating the laminated lens blank to an elevated temperature sufficient to at least partly relieve bond stress present in the glass core element and plastic surface layers; and (b) grinding material from the edge of the laminated lens blank to achieve a selected finished edge configuration while maintaining the lens at said elevated temperature.

2. A method for edge-finishing a glass-plastic laminated lens blank comprising a relatively thin, compressively stressed sheet glass core element positioned between and adhesively bonded to two relatively thick, tensilely stressed plastic surface layer elements which comprises the steps of:

(a) heating the laminated lens blank to an elevated temperature sufficient to at least partly relieve bond stress present in the glass core element and plastic surface layers;

(b) grinding material from the edge of the laminated lens blank to achieve a selected finished edge configuration while maintaining the lens blank at said elevated temperature; and (c) exposing the edge of the glass core element to a glass etching medium for a time at least sufficient to essentially completely eliminate surface flaws present thereon.

3. A method in accordance with claims 1 or 2 wherein the laminated lens blank is heated by the application of a heated flushing fluid thereto.

4. A method in accordance with claims 1 or 2 wherein the laminated lens blank is heated to a temperature sufficient to reduce the bond stress near the edges of the blank to a level below about 4000 psi.

5. A method in accordance with claims 1 or 2 wherein the laminated lens blank is heated to a temperature in the range of about 40°-100° C.

6. A method in accordance with claim 2 wherein the glass etching medium consists of an aqueous solution comprising a fluoride compound selected from the group consisting of HF, $NH_4F$ and $NH_4F.HF$.

* * * * *